US008758084B2

(12) United States Patent
Knecht et al.

(10) Patent No.: US 8,758,084 B2
(45) Date of Patent: Jun. 24, 2014

(54) APPARATUS FOR GRINDING HAND KNIVES

(75) Inventors: Manfred Knecht, Bergatreute (DE); Peter Heine, Bodnegg (DE)

(73) Assignee: Knecht Maschinenbau GmbH, Bergatreute (DE)

( * ) Notice: Subject to any disclaimer, the term of this patent is extended or adjusted under 35 U.S.C. 154(b) by 438 days.

(21) Appl. No.: 13/067,069

(22) Filed: May 5, 2011

(65) Prior Publication Data

US 2011/0281503 A1 Nov. 17, 2011

(30) Foreign Application Priority Data

May 7, 2010 (DE) ..... 10 2010 019 852

(51) Int. Cl.
*B24B 49/06* (2006.01)

(52) U.S. Cl.
USPC ..... 451/5; 451/9; 451/10; 451/11; 451/45

(58) Field of Classification Search
USPC ..... 451/5, 8, 9, 10, 11, 45, 419
See application file for complete search history.

(56) References Cited

U.S. PATENT DOCUMENTS

| | | | | |
|---|---|---|---|---|
| 5,195,929 | A * | 3/1993 | Felstehausen | 460/48 |
| 5,217,424 | A * | 6/1993 | Pallmann | 483/1 |
| 5,232,404 | A * | 8/1993 | Felstehausen | 460/48 |
| 5,237,900 | A * | 8/1993 | Supe-Dienes et al. | 83/563 |
| 6,142,046 | A * | 11/2000 | Mierau et al. | 83/62.1 |
| 6,503,135 | B2 * | 1/2003 | Clauss et al. | 451/419 |
| 6,663,465 | B2 * | 12/2003 | Gross | 451/5 |
| 2002/0009963 | A1 * | 1/2002 | Clauss et al. | 451/419 |
| 2002/0025757 | A1 * | 2/2002 | Gross | 451/5 |

* cited by examiner

*Primary Examiner* — Eileen P. Morgan
(74) *Attorney, Agent, or Firm* — Breneman & Georges

(57) ABSTRACT

An apparatus for grinding hand knives, in particular for meat processing, with at least one grinding tool is proposed, by means of which a knife ground finish, in particular during the reconditioning of hand knives after use, is made possible in a repeatable manner with reproducible grinding quality. This is achieved according to the invention in that a knife magazine (6, 7) for accommodating at least one hand knife is provided, in that a driven manipulating device (3, 4, 5) having at least one knife gripper (5) is provided, in that at least one sensor unit (22) for at least partly recording the knife contour is provided, and in that an electronic evaluating and control unit for evaluating the sensor data and for activating the manipulating device (3, 4, 5) is provided.

19 Claims, 2 Drawing Sheets

APPARATUS FOR GRINDING HAND KNIVES

Figure 1:
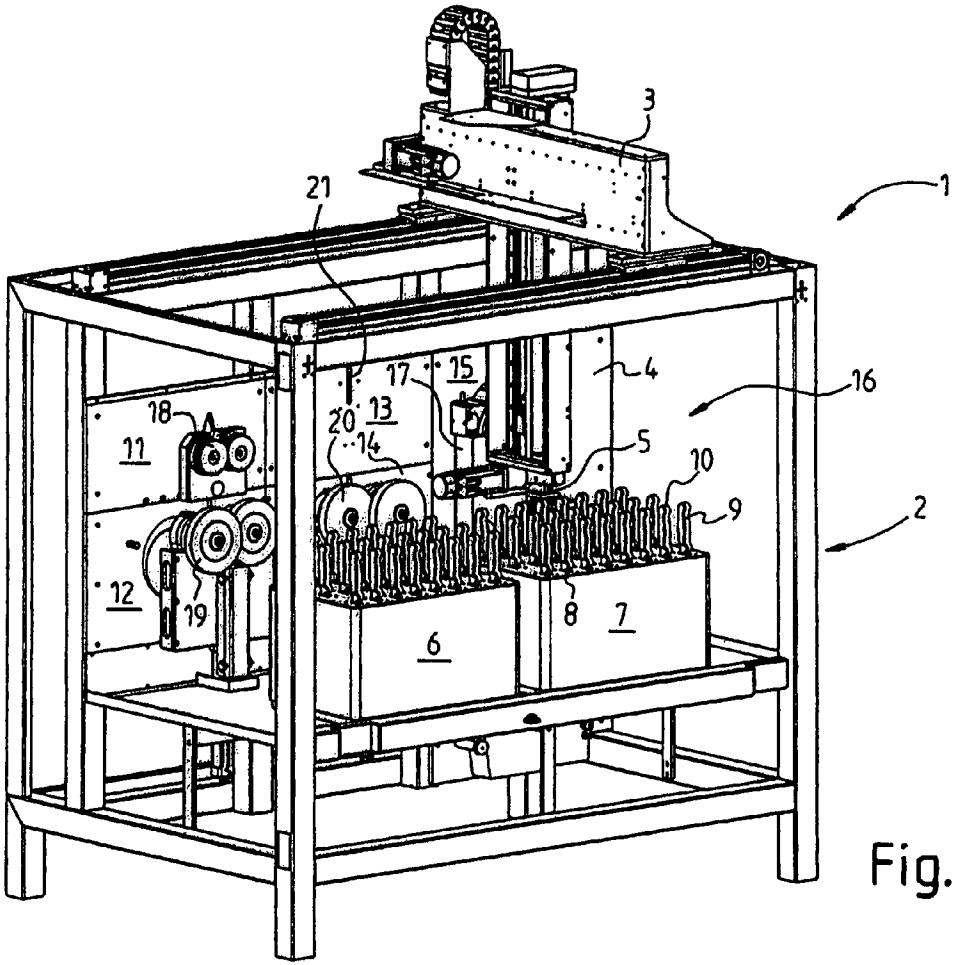

The invention relates to an apparatus for regrinding hand knives and more particularly the regrinding of the cutting edge of a meat processing hand knife with at least one grinding tool.

In particular in meat processing, hand knives having different profiles are provided for various applications. The profile and the ground finish of the hand knives also differ depending on the country or the region of the meat processing.

The performance of the personnel also depends on the quality of the ground finish, which manually is not always uniform.

Such hand knives have hitherto been reground by hand on a grinding machine, this activity often being carried out by the personnel who deal with the cutting of the meat. In many meat product companies, there are central grinding departments in which one person grinds all the knives. This is very hard work and is also limited in the working capacity, and so no more than 200 knives per day can be ground by one person.

In addition, wear of the hand knife involves repeated grinding operations, and therefore the profile originally provided is altered.

Grinding machines having measuring systems and a control for the automatic grinding of knives have been disclosed in various publications, for example JP 60 39 690, DE 100 21 302 A1 or DE 203 14 680 U1. These machines serve to provide new knives with a predetermined cutting edge profile.

In JP 60 36 690, for producing a knife, data acquisition of the knife contour is carried out in order to compare it with stored, predetermined values and control a grinding tool from this comparison. Regrinding of hand knives having varying wear is not possible with this arrangement.

No sensory probing of a knife is provided in DE 100 21 302 A1. Here, work is carried out in a data memory according to predetermined data. With an apparatus according to this prior art, reworking of worn knives is not possible either.

Publication DE 203 14 680 again shows a grinding machine having a measuring system and a control for providing a master blade for machining. In the machine, in particular the application in a milling machine is described. In this prior art, too, the blade is first of all processed according to predetermined data. Only after that is the blade alternately measured and reground until the actual data correspond to the desired data. Such an apparatus is also not suitable for regrinding hand knives having varying wear.

The object of the invention is therefore to propose an apparatus by means of which a knife ground finish, in particular during the reconditioning of hand knives after use, is made possible in a repeatable manner with reproducible grinding quality.

Based on an apparatus to regrind the cutting edge of a meat processing hand knife with at least one grinding tool having a knife magazine, a driven knife gripper and a sensor to measure all or part of the contour of a knife cutting edge and an evaluation unit to compare measured data with stored data and a control unit to control the movement of the at least one grinding tool to grind only that part of the knife needed to sharpen the cutting edge of the hand knife and a method for grinding hand knives utilizing the steps of seizing the hand knife with a knife gripper, sensing data as to the actual contour of the knife cutting edge and comparing the sensed data with recorded data and having at least one grinding operation to grind only part of the contour needing sharpening based on recorded data and sensed data.

Advantageous developments and embodiments of the invention are possible by the measures referred to in the dependent claims.

Accordingly, an apparatus according to the invention and a method according to the invention are distinguished by the fact that a knife magazine for accommodating at least one hand knife is provided, that a motor-driven manipulating device having at least one knife gripper is provided, that at least one sensor unit for recording data to be assigned to the contour of the knife cutting edge is provided, and that an electronic evaluating unit for evaluating the sensor data and for determining a processing movement between the knife cutting edge and the grinding tool is provided, said processing movement following at least part of the contour, detected by sensor, of the knife cutting edge, and that a control unit for controlling the processing movement is provided.

By means of such an apparatus, automatic regrinding of hand knives having cutting edge contours worn to a varying degree and thus also altered relative to the new state is possible, in which case good, repeatable grinding quality can always be ensured.

The knife magazine permits safe protection of one or more hand knives to be ground, which are subsequently fed to the grinding operation by a manipulating device. The cutting edge contour can be recorded by the sensor unit, such that this contour can be followed by the electronic evaluating and control unit during the grinding. In particular, an existing contour of a worn knife can thus be exactly reground.

In a special embodiment of the invention, stationary processing tools are used. These processing tools, which can be motor-driven, then define a position at which the knife to be ground is positioned, for example by means of the manipulating device, with its blade at the processing location and if need be is guided during the processing.

In this case, processing tools which rotate about a horizontally mounted axis are preferably provided, such that the hand knives to be ground can be guided along the tool in a substantially horizontal orientation. Here, in an especially advantageous manner, two grinding tools of the same type are provided in a contra-rotating manner, such that a knife cutting edge can be processed simultaneously from two sides.

In a special embodiment of the invention, different processing tools are provided, for example for grinding, for polishing and for deburring the knife blades. To this end, a modular construction of the tools is preferably provided, and therefore such an apparatus, depending on requirements, can be constructed with different tools. The knife processing is adapted to the respective machine construction via the evaluating and control unit, which can store the corresponding processing positions of the working tools in a data memory.

The processing tools are preferably arranged on a rear wall of a work space, since they define at the same time the work space on this side. The working tools are therefore arranged at a maximum safety distance from an operator standing at the front side. In addition, the working tools can be driven on the rear side of this rear wall, such that work space and drive space are separated. The drive side of the apparatus is therefore screened from contaminants which can occur in the work space due to the grinding operation itself or due to corresponding abrasives, for example in the form of grinding emulsions or the like. In addition, mounting on the rear side is simplified, the drive motors also being easily accessible from the rear side for maintenance.

For the flexible modular construction of the tools, depending on the intended use, the rear wall is composed of individual module-like plates, such that a tool can be exchanged or fitted by correspondingly exchanging or mounting such a plate. The individual module plates, when fitted together, form the rear wall of the work space and separate the latter from the drive space.

The sensor unit for recording data of the contour of the knife cutting edges is advantageously accommodated in the drive space, and so the sensor unit is also largely protected from contaminants. In this case, to at least partly record the knife contour, an opening can be provided in the rear wall, for example in one or more of the above-described module-like wall plates of the rear wall, through which opening the knife blade can be inserted. When plates are arranged adjacent to one another, a corresponding opening in the rear wall of the work space can also be realized by recesses in respective plates.

All known and future sensor techniques by means of which a knife contour can be recorded are suitable for the sensor unit. In addition to mechanical probing, the data acquisition can be effected, for example, by capacitive, inductive, optical methods and/or by means of ultrasound or the like, in particular also by scanners or cameras.

In an apparatus according to the invention, a magazine for a plurality of knives, in particular also for a greater variety of knives, is provided so that the degree of automation is increased. In a special embodiment, such a magazine can be designed in the form of a box which has a lid plate. Knife receptacles can be arranged in this lid plate, and the hand knives can be inserted with their blades into said knife receptacles. Such a magazine offers the advantage that the blade side of the knives project into the interior of the box and are thus screened by the wall thereof, whereas the knife handles are accessible on the lid side. This type of knife magazine offers a high degree of occupational safety. In principle, however, other magazine configurations having a high degree of safety are also possible, in which the blade side of the knives is screened to the outside and the knife handles are accessible from outside.

An insertion contour, which facilitates the insertion of the knife blades by means of the manipulating device, is preferably provided in a knife receptacle. Such an insertion means can be designed, for example, in a funnel shape or with an inclined contact surface. As a result of such a mechanical insertion aid, greater tolerance can be provided in the accuracy of the manipulating device in the region of the knife magazine. Likewise, the knife magazine can be positioned with greater tolerance, since even a knife that does not strike the knife receptacle exactly can nonetheless be reliably inserted by the insertion aid during the insertion by the manipulating device.

The knife receptacles and/or the insertion aids are preferably designed to be at least partly elastic. In this way, the knife receptacle can yield when a knife striking in a slightly offset matter is inserted, such that the knife blade can nonetheless be inserted into the receptacle. After the knife handle is released by the gripper, tight fixing of the knife in the magazine is ensured by recovery of the elastic regions of the knife receptacle or of the insertion aid.

To increase the degree of automation, change magazines which permit an automatic magazine change in a corresponding loading unit can also be provided.

The grinding operation is preferably carried out in such a way that a hand knife can be seized at the handle by the gripper, such that no change of grip is required for initiating the grinding operation, as would be the case, for example, if the knife were seized in the blade region by the gripper.

After that, the knife is fed by means of the manipulating device to one or more sensor units, such that the data for recording the grinding contour can be read off or tapped.

The manipulating device can then feed the corresponding hand knife to the different processing tools. The knife is preferably fed first of all to a grinding tool where the knife profile is partly ground or reground exactly.

In a further method step, an angle is then ground in the cutting edge in such a way as to follow the profile partly ground beforehand, wherein this angle is either determined beforehand by the sensor unit or can be set in accordance with the intended purpose, and can preferably be selected from a multiplicity of stored setting possibilities.

By means of the manipulating device, the evaluating and control unit can then direct the knife to the corresponding deburring tool for deburring. In a corresponding manner, a polishing operation is carried out afterwards, provided a polishing tool is provided.

In principle, such a machine can also be used for grinding a preprogrammed profile in a knife, for example during the new production of the knife. However, the special advantage including the sensor unit is obtained during the regrinding, since in this way a predetermined profile can be followed precisely.

Grinding of hand knives with a reliably reproducible grinding result and high efficiency is possible by means of the apparatus according to the invention. Instead of the manual regrinding, the blunt knives are now ground automatically.

An exemplary embodiment of the invention is shown in the drawing and is explained in more detail with reference to the figures.

Figure 2:
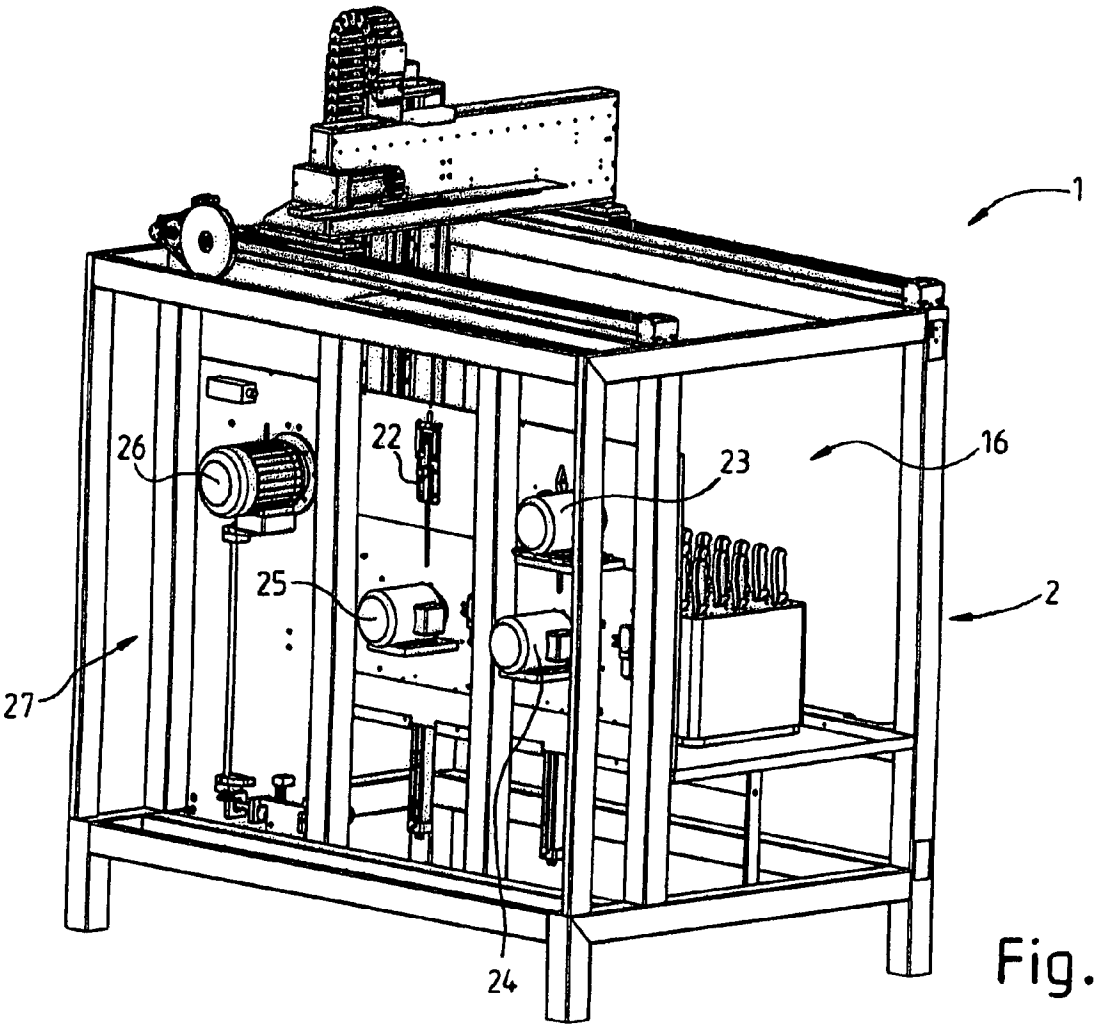

In the drawing, in particular:

FIG. 1 shows a perspective illustration of a grinding machine according to the invention, with a view of the work space, and FIG. 2 shows an illustration corresponding to FIG. 1, with a direction of view toward the drive space.

The machine 1 comprises a machine frame 2 which carries the further components. A manipulating device in the form of a cross slide 3 having a vertical extension arm 4 and a gripper 5 facilitates the traversability of the gripper 5 in three coordinate directions. In addition, the gripper 5 is designed to be rotatable, at least about a horizontal axis of rotation.

Two knife magazines 6, 7, which are of box-shaped construction and have knife receptacles 8 in the lids, contain various hand knives 9, of which only the knife handles 10 can be seen in the drawing since the knife blades are arranged in the knife receptacles 8 and therefore in the interior of the knife magazines 6, 7.

A plurality of plates 11, 12, 13, 14, 15 are arranged as a perpendicular partition in the machine frame 2 and form the rear wall of a work space 16.

The plate 15 carries a revolving belt grinding tool 17. The plate 11 carries two grinding tools 18, each rotating about a horizontal axis. The plate 12, in this embodiment, carries two deburring tools 19, each rotating about a horizontal axis, and the plate 14 carries two polishing tools 20, each likewise rotating about a horizontal axis. The plate 13 comprises a slot-shaped aperture 21 in order to push through a knife blade.

FIG. 2 shows the rear side of the plates 11, 12, 13, 14, 15. A sensor unit 22 is attached to the rear side of the plate 14 in order to probe the profile of a knife blade or at least partly comprehend said profile in another manner.

Furthermore, drive motors 23, 24, 25, 26 of the processing tools 17, 18, 19, 20 can be seen on the plates 11, 12, 13, 15.

The plates 11, 12, 13, 14, 15 form a partition between the work space 16 and the drive space 27, such that drives 23, 24, 25, 26 and the sensor unit 22 are screened from contaminants from the work space 16.

The grinding machine 1 operates in such a way that a knife is removed from the respective knife receptacle 8 at the knife handle 10 by means of the gripper 5. This knife can be pushed through the aperture 18 in the plate 13 by pivoting the knife in a horizontal direction. Depending on the form of the sensor 19, the data acquisition with regard to the knife contour or the contour of the knife cutting edges can be effected in the appropriate manner. For example, the profile can be probed or scanned in the course of a horizontal linear movement.

Instead of the sensor unit 22, a camera could also be attached in order to record the knife blade, for example by an imaging process.

After the data acquisition, the knife can be fed in the corresponding processing position to the various processing tools 17, 18, 19, 20. In the case of the rotating processing tools shown in the exemplary embodiment and arranged in a stationary position, the knife contour is followed by a superimposition of movements of the gripper 5, since the processing tools are arranged in a stationary position. By a linear movement in a horizontal direction and by pivoting movements or also lifting movements of the gripper, virtually any desired knife contour detected by a sensor can be directed past the stationary processing tools.

The machine 1 can be completely closed by side covers. For the sake of clarity, said side covers are removed in the perspective illustrations according to FIGS. 1 and 2.

As a result of the setup of the processing tools in separate plates 11, 12, 13, 14, 15, different processing tools can be easily fitted, and they can be quickly exchanged. The machine 1 can be configured in a modular manner, depending on which type of knife processing is desired.

A machine as shown permits a precise, reproducible regrind of hand knives having widely varying wear marks, with high efficiency and grinding quality.

LIST OF DESIGNATIONS

1 Grinding machine
2 Machine frame
3 Cross slide
4 Vertical extension arm
5 Gripper
6 Knife magazine
7 Knife magazine
8 Knife receptacle
9 Hand knife
10 Knife handle
11 Plate
12 Plate
13 Plate
14 Plate
15 Plate
16 Work space
17 Belt grinding tool
18 Grinding tool
19 Deburring tool
20 Polishing tool
21 Aperture
22 Sensor unit
23 Motor
24 Motor
25 Motor
26 Motor
27 Drive space

What is claimed is:

1. An apparatus for regrinding a cutting edge of hand knives comprising:

(a) at least one knife edge grinding tool;
(b) a knife magazine (6, 7) to hold at least one hand knife,
(c) a driven knife gripper (5);
(d) at least one contour sensor unit (22) to measure data on all or part of the contour of the knife cutting edge,
(e) an electronic evaluating unit to evaluate the measured data with stored knife cutting edge data; and
(f) a control unit to control movement between the knife cutting edge and the knife edge grinding tool to grind only that part of the knife cutting edge needed to be sharpened in order to restore the at least one hand knife back to an original cutting edge profile.

2. The apparatus according to claim 1 further comprising at least one stationary processing tool (17, 18, 19, 20).

3. The apparatus according to claim 2 wherein the at least one stationary processing tool (17, 18, 19, 20) has a horizontal axis of rotation.

4. The apparatus according to claim 1 further comprising a work space (16) having a table with a rear wall (3) and a vertical extension arm (4) wherein the knife edge grinding tool is attached to the rear wall of the work space (16).

5. The apparatus according to that claim 4 wherein the rear wall has at least two plates (11, 12, 13, 14).

6. The apparatus according to claim 4 wherein the rear wall separates a work space from a drive space.

7. The apparatus according to claim 6 wherein the at least one sensor unit (22) is arranged in the drive space (27).

8. The apparatus according to claim 1 wherein the knife magazine accommodates a plurality of hand knives and has blade receptacles and externally accessible handle positions.

9. The apparatus according to claim 1 further comprising a knife receptacle with an insertion aid.

10. The apparatus according to claim 9 wherein the knife receptacle is at least partly elastic.

11. The apparatus according to claim 1 further comprising an automatic change magazine for a plurality of knives.

12. A method for grinding hand knives comprising the steps of:

seizing a hand knife with a knife gripper, sensing a contour of a knife cutting edge with a sensor unit to obtain data that is the actual contour of the knife cutting edge and comparing the sensing data from the sensor unit with recorded data on the knife cutting edge, and grinding the knife cutting edge with a grinding tool during at least one grinding operation along only the part of the contour of the knife cutting edge needing sharpening using the recorded data and the sensing data detected by sensor to restore the knife back to an original cutting edge profile, wherein the grinding operation is carried out with a control unit that controls movement between the knife cutting edge and the grinding tool.

13. The method of claim 12 wherein the sensing unit is a camera.

14. The method of claim 12 further comprising the step of deburring or polishing the knife cutting edge.

15. A machine for sharpening all or a portion of a knife edge comprising:

(a) a substantially flat workpiece table having a workpiece slide, a workspace and a drive space connected to the substantially flat workpiece table;
(b) a knife gripper disposed in the workpiece slide communicating between the substantially flat workpiece table and the workspace;
(c) a plurality of plates having a workpiece side and a drive side to separate the workspace from the drive space;

(d) at least one grinding tool disposed on the workpiece side of one of the plurality of plates and at least one drive motor disposed on the drive side of one of the plurality of plates;

(e) a sensing unit for sensing a contour of a knife cutting edge to provide sensor data on the actual contour shape of the knife cutting edge;

(f) an evaluation unit for evaluating the sensor data on the actual contour shape of the knife cutting edge compared with a previously stored contour knife cutting edge data; and (g) a control unit to operate the knife gripper, the sensing unit, the evaluation unit and the at least one grinding tool to sharpen all or a portion of the knife cutting edge such that the movement between the grinding tool and knife cutting edge are controlled to grind only that part of the knife cutting edge necessary to restore the knife back to an original cutting profile.

16. The machine of claim 15 further comprising a deburring tool and a polishing tool.

17. The machine of claim 16 wherein the deburring tool and the polishing tool is disposed on a separate plate on one of said plurality of plates.

18. The machine of claim 15 wherein the sensing unit is disposed on the drive side of one of the plurality of plates.

19. The machine of claim 18 wherein the plate on which the sensing unit is disposed has a slot shaped aperture to receive a knife blade.

* * * * *